US008104401B1

(12) United States Patent
Powell

(10) Patent No.: US 8,104,401 B1
(45) Date of Patent: Jan. 31, 2012

(54) PLASTIC BOTTLE CRUSHER

(76) Inventor: Henry Powell, Torrox Casta (ES)

( * ) Notice: Subject to any disclaimer, the term of this patent is extended or adjusted under 35 U.S.C. 154(b) by 76 days.

(21) Appl. No.: 12/434,103

(22) Filed: May 1, 2009

(51) Int. Cl.
*B30B 1/00* (2006.01)
*B30B 9/06* (2006.01)

(52) U.S. Cl. ..... 100/110; 100/131; 100/229 A; 100/247; 100/265; 100/902

(58) Field of Classification Search ..... 100/104, 100/110, 116, 126, 127, 131, 214, 215, 226, 100/247, 265, 902, 227, 229 A, 246; 241/99
See application file for complete search history.

(56) References Cited

U.S. PATENT DOCUMENTS

| | | | | |
|---|---|---|---|---|
| 200,487 | A * | 2/1878 | Stears | 100/125 |
| 2,581,294 | A * | 1/1952 | Read et al. | 100/98 R |
| 2,614,604 | A | 10/1952 | Coffey | |
| 2,800,160 | A | 7/1957 | Wilson et al. | |
| 3,980,015 | A | 9/1976 | Woodard | |
| 4,133,261 | A | 1/1979 | Belfils | |
| 4,224,469 | A * | 9/1980 | Karson | 381/353 |
| 4,459,905 | A * | 7/1984 | Wilson | 100/35 |
| D324,390 | S | 3/1992 | Byers | |
| 5,293,816 | A * | 3/1994 | Musumeci et al. | 100/245 |
| 5,361,690 | A * | 11/1994 | Hsu | 100/48 |
| 5,448,946 | A * | 9/1995 | Laux | 100/249 |
| 5,832,818 | A * | 11/1998 | Menzak, Jr. | 100/92 |
| 5,848,569 | A | 12/1998 | Maki et al. | |
| 6,076,455 | A | 6/2000 | Geise | |
| 6,481,346 | B1 * | 11/2002 | Miller | 100/269.13 |
| 6,571,696 | B1 * | 6/2003 | Adam | 100/214 |
| 6,598,522 | B2 * | 7/2003 | Yamaguchi | 100/42 |
| 7,475,633 | B2 * | 1/2009 | Weinberg | 100/289 |

FOREIGN PATENT DOCUMENTS

| | | | |
|---|---|---|---|
| FR | 2692190 | A1 * | 12/1993 |
| FR | 2712230 | A1 * | 5/1995 |

* cited by examiner

*Primary Examiner* — Jimmy T Nguyen

(57) ABSTRACT

The invention is a plastic bottle crushing that includes a housing having a slidable tray that is positioned underneath the bottle to be crushed in order for any remaining liquids contained within said bottle to be collected. The housing also includes a bottom crushing surface that has a hole in order to support the top portion of the plastic bottle in an inverted position. The invention may be either manually operated or by an automated mechanical means.

9 Claims, 5 Drawing Sheets

12
12A
10

50
11D
11A
11
11C
13

PLASTIC BOTTLE CRUSHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of bottle crushing apparatus, more specifically, a plastic bottle crusher that has a tray for collecting any liquids remaining in a plastic bottle prior to or during the crushing process.

Liquid container crushing mechanisms have been around for along time, and most notably are designed for use with aluminum cans. However, container crushing mechanisms suited for use with either an aluminum can or plastic bottle are typically messy in that any liquid remaining within said container usually drips onto the componentry of the crushing mechanism, which in turn creates an unwanted mess.

The present invention seeks to overcome this disadvantage by utilizing a vertical bottle crushing mechanism that has an opening for the support of a top-end of a plastic bottle and of awaiting tray below.

B. Discussion of the Prior Art

As a preliminary note, it should be stated that there is an ample amount of prior art that deals with bottle crushers. As will be discussed below, no piece of prior art discloses a bottle crusher that has a remains catching tray and of which is either manually operated or automated.

The Geise Patent (U.S. Pat. No. 6,076,455) discloses an aluminum can crushing mechanism which has a vertical arrangement and is operable by the hand. However, the crushing mechanism is directed to use with aluminum cans, and does not have a tray to collect remaining liquids contained within the object to be crushed.

The Maki et al. Patent (U.S. Pat. No. 5,848,569) discloses a can crusher that moves from an open to a closed position. Again, the crushing mechanism is designed for use with a can, preferably aluminum, and of which does not include a tray for collection remains contained within the container and of which is suited for use with a plastic bottle.

The Coffey Patent (U.S. Pat. No. 2,614,604) discloses a flattening device for use with cans. Again, the device is designed for use with a can, preferably aluminum, and of which does not include a tray for collection remains contained within the can.

The Wilson et al. Patent (U.S. Pat. No. 2,800,160) discloses a device for flattening cans that is mountable. Again, the device is designed for use with a can and does not include the tray for collection remains contained within the can.

The Woodard Patent (U.S. Pat. No. 3,980,015) discloses a device for crushing cans having two crushing members having handles. However, the crushing device crushes the container in a horizontal position as opposed to a vertical position, wherein a collecting tray can collect any remaining liquid remaining within the container.

The Belfils Patent (U.S. Pat. No. 4,133,261) discloses a device for crushing beverage containers. However, the crushing device does not have a tray for collection of any remaining liquids.

While the above-described devices fulfill their respective and particular objects and requirements, they do not describe a bottle crushing device that has a tray for collection of liquids remaining inside of the bottle to be crushed, and of which has a bottom crushing surface containing a hole for support of the top portion of a bottle for the crushing process. In this regard, the plastic bottle crusher departs from the conventional concepts and designs of the prior art.

SUMMARY OF THE INVENTION

The invention is a plastic bottle crushing that includes a housing having a slidable tray that is positioned underneath the bottle to be crushed in order for any remaining liquids contained within said bottle to be collected. The housing also includes a bottom crushing surface that has a hole in order to support the top portion of the plastic bottle in an inverted position. The invention may be either manually operated or by an automated mechanical means.

It is an object of the invention to provide a plastic bottle crusher that includes a means for collecting any remaining liquids contained within a bottle to be crushed.

A further object of the invention is to provide a plastic bottle crusher that is either manually operated or operated by an automated mechanical system.

A further object of the invention is to provide a plastic bottle crusher that is lightweight, effective, easy to operate, and affordable.

In this respect, before explaining the current embodiments of the plastic bottle crusher in detail, it is to be understood that the plastic bottle crusher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the plastic bottle crusher. It is therefore important that the claims be regarded as including such equivalent construction insofar as they do not depart from the spirit and scope of the plastic bottle crusher. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
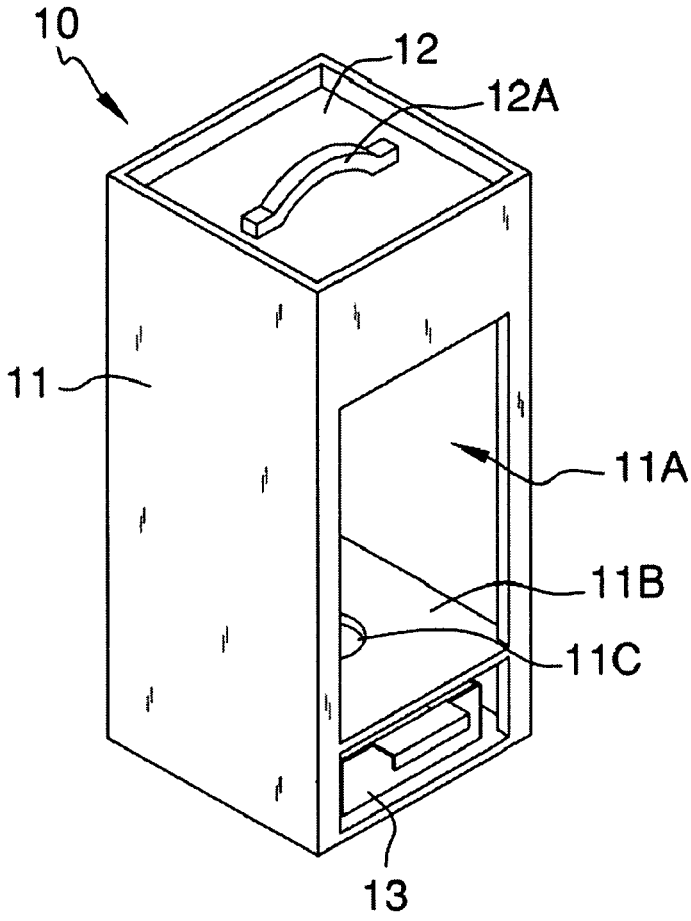
FIG. 1 illustrates an isometric view of the invention with a bottle crusher in a top position and without a bottle located within the housing.

Detailed reference will now be made to the preferred embodiment of the present invention, examples of which are illustrated in FIGS. 1-5. A plastic bottle crusher 10 (hereinafter invention) includes a housing 11, a bottle crusher 12, and tray 13.

The housing 11 is generally of a rectangular, box shape having a front opening 11A, which is for ingress or egress of a plastic bottle 50. The housing 11 also has a bottom crushing surface 11B, which separates the front opening 11A into two distinct openings.

Figure 3:
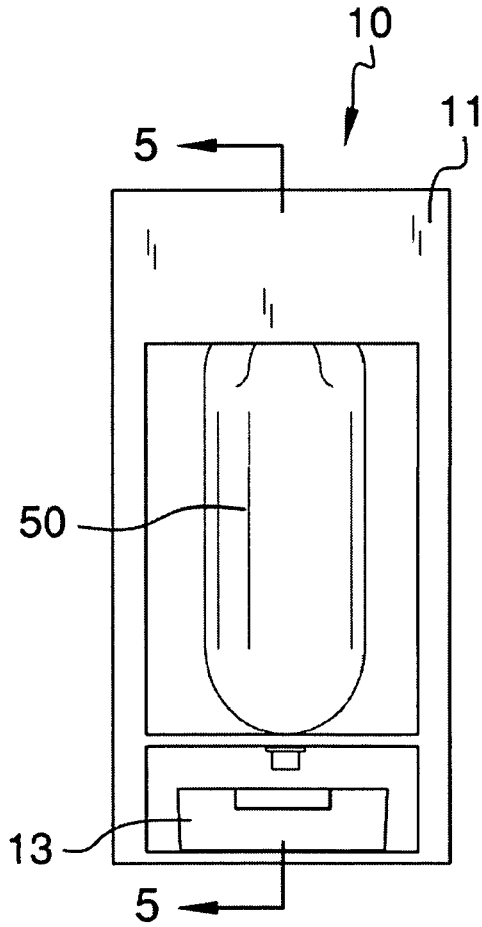
FIG. 3 illustrates a front view of the invention with a bottle located within the invention and wherein the bottle crusher is in the top position.
Figure 2:
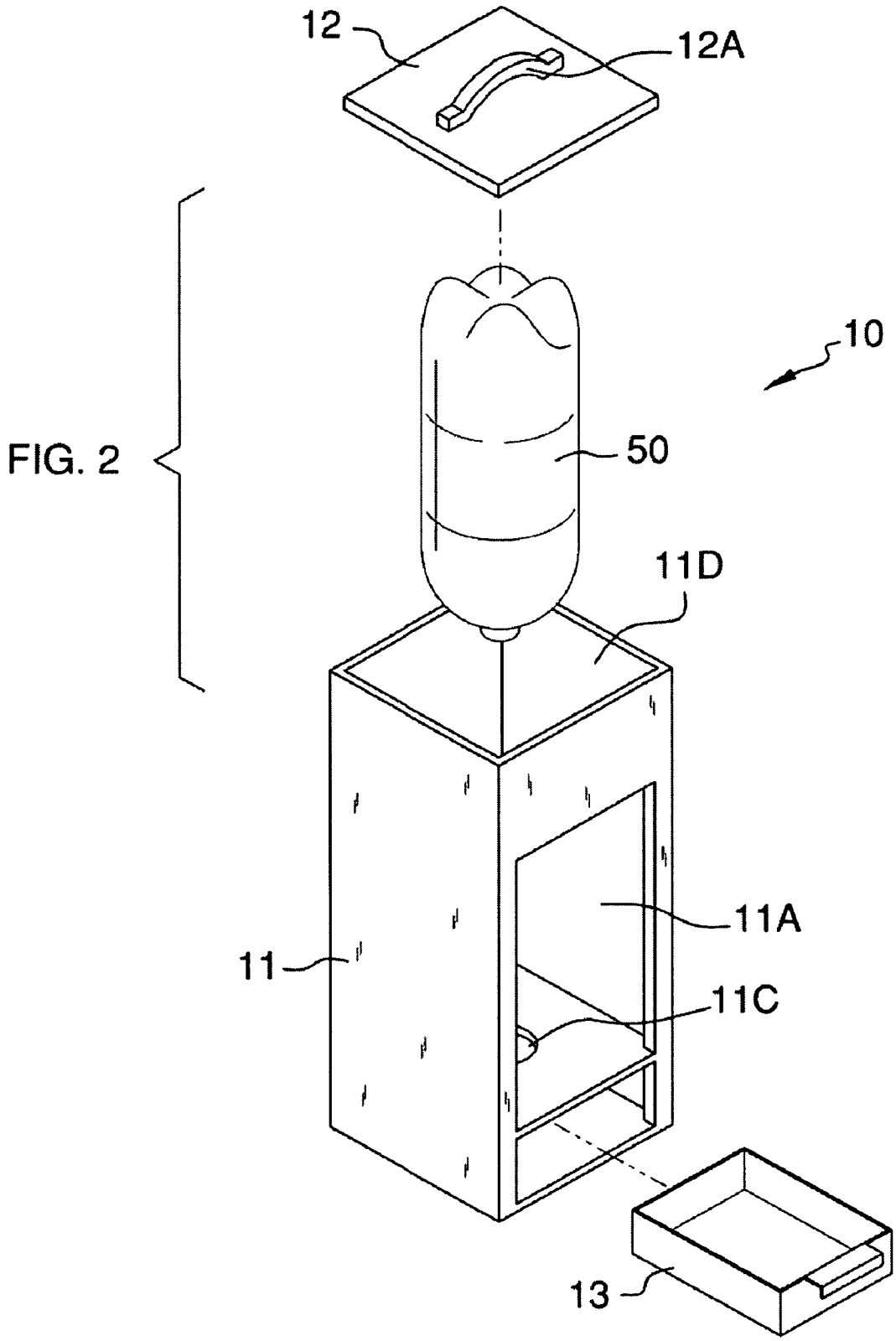
FIG. 2 illustrates an isometric, exploded view of the invention with a plastic bottle.
Figure 4:
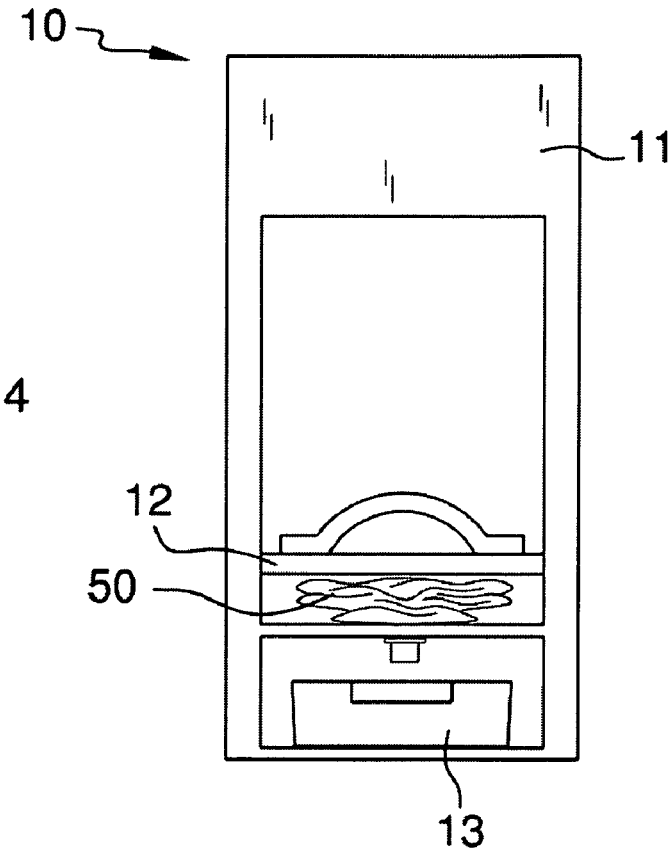
FIG. 4 illustrates a front view of the invention in use with a crushed plastic bottle contained inside of the invention with the bottle crusher in a bottom position.
Figure 5:
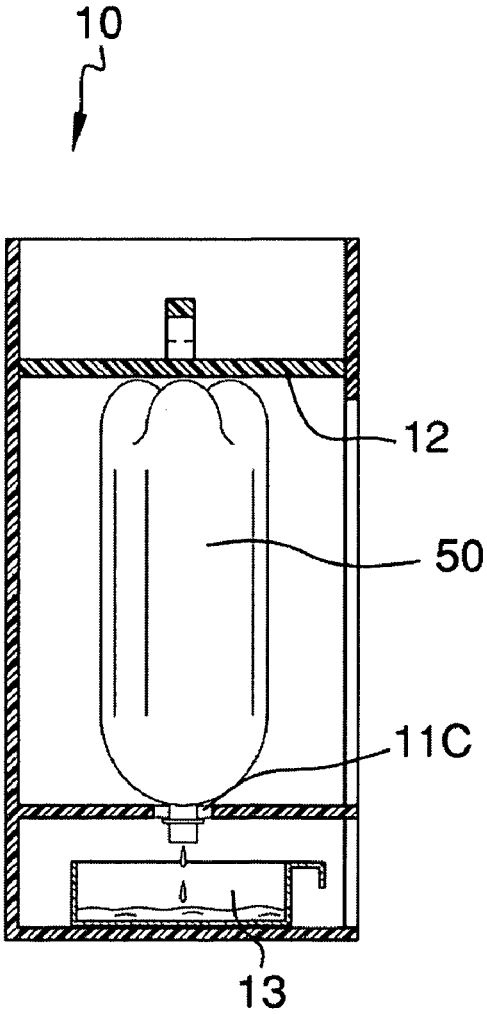
FIG. 5 illustrates a cross-sectional view of the invention along line 3-3.

The bottom crushing surface 11B has a hole 11C that is positioned about the center of the bottom crushing surface 11B and is suited for use in supporting the plastic bottle 50 in an inverted position, as depicted in FIGS. 3-5. The bottom crushing surface 11B must be securely attached to the housing 11 as it must withstand the force exerted upon the crushing of the plastic bottle 50.

Below the bottom crushing surface 11B is where the tray 13 may be placed. The tray 13 is designed to collect any remaining liquid contained within the plastic bottle 50, which would be released upon placing the plastic bottle 50 in an inverted position upon the hole 11C of the bottom crushing surface 11B. It shall be noted that the inclusion of the tray 13 and the hole 11C in the bottom crushing surface 11B in order to collect fluid remaining within the plastic bottle 50 is an important feature of the invention 10.

It shall also be noted that once the plastic bottle 50 has been crushed, that a top (not shown) of the plastic bottle 50 be screwed back onto the plastic bottle 50, and thus insure that the plastic bottle 50 maintain the newly formed shaped as a result of the invention 10.

The housing 11 also has a top opening 11D which enables ingress or egress of the bottle crusher 12 and/or the plastic bottle 50. The bottle crusher 12 has a handle 12A.

It shall be noted that the shape of the housing 11 and the corresponding shape of the bottle crusher 12 may be of any of a plurality of shapes. The housing 11, the bottle crusher 12, and the tray 13 may be made of a material comprising wood, metal, a durable plastic, or a carbon fiber construction.

The invention 10 is operated by removing the bottle crusher 12 from the housing 11, and placement of the plastic bottle 50 about the hole 11C of the bottom crushing surface 11B by entryway of either the front opening 11A or the top opening 11D in the housing 11. Next, the bottle crusher 12 is placed over the top opening 11D and pushed down upon and thus crushing the plastic bottle 50.

Figure 6:
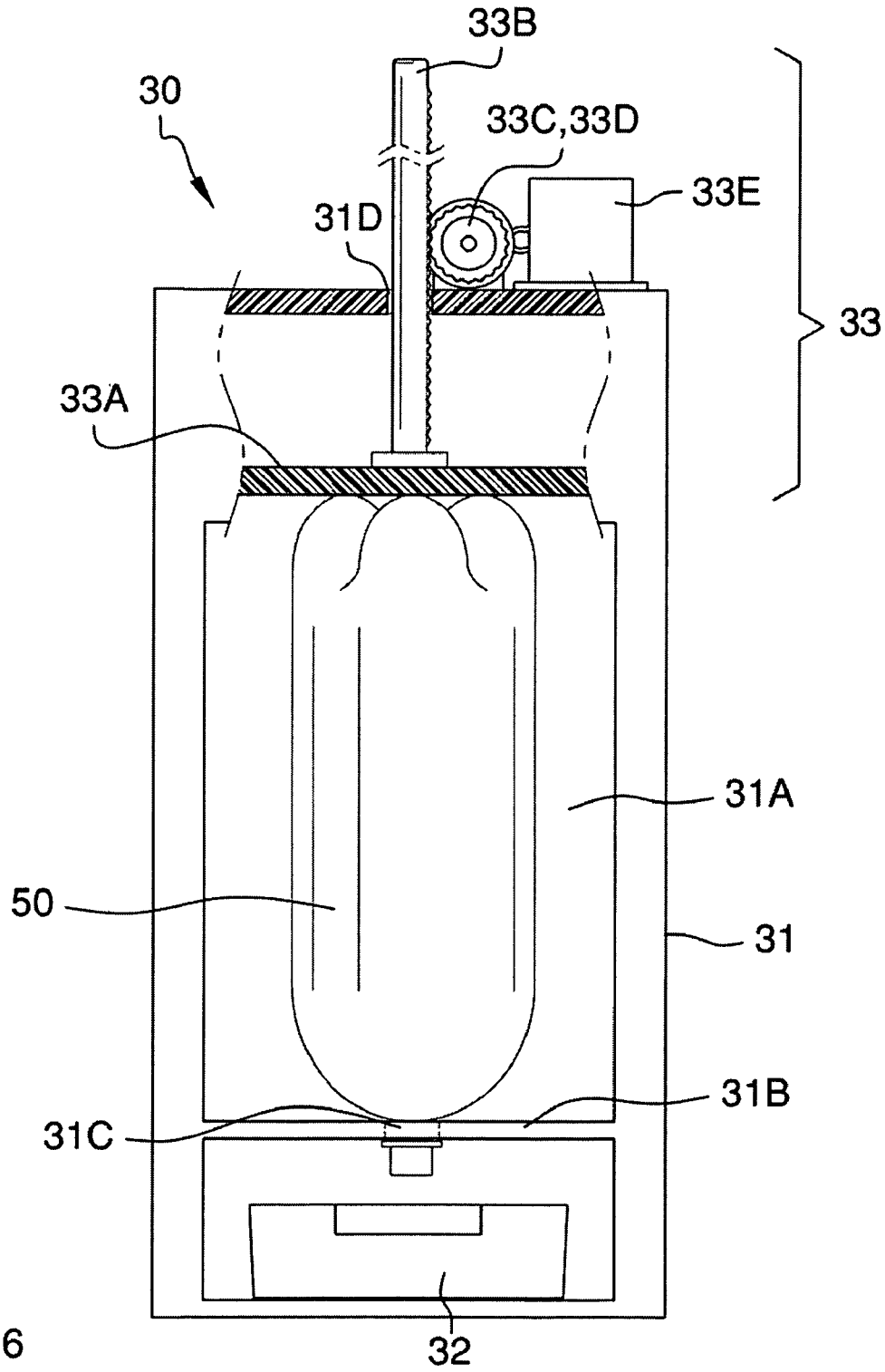
FIG. 6 illustrates a cross-sectional view of a second embodiment of the invention having an automated mechanical means of crushing a plastic bottle.

Referring to FIG. 6, an alternative embodiment 30 includes a housing 31 having a front opening 31A, bottom crushing surface 31B, a hole 31C located about the center of the bottom crushing surface 31B, and a top hole 31D. The alternative embodiment 30 also includes a tray 32, a bottle crushing means 33.

The bottle crushing means 33 includes a crushing surface 33A, a drive shaft 33B, motor 33C, a gear system 33D, and a controller 33E. The controller 33E turns on or off the motor 33C, which in turn rotates the gear system 33D. The controller 33E is also capable of operating the motor 33C forwards or backwards, which in turn drives the gear system 33D forwards or backwards. The gear system 33D drives the drive shaft 33B up or down. The drive shaft is mounted upon a top surface of the crushing surface 33A. As such, the controller 33E pushes the crushing surface 33A up or down thereby crushing the plastic bottle 50 contained therein.

The motor 33C, the gear system 33D, and the controller 33E may be mounted to the housing 31 adjacent the top hole 31D. The drive shaft 33B is capable of vertical movement via the top hole 31D.

It shall be noted that the motor 33C and the gear system 33D must be capable of generating enough crushing force to actually crush the plastic bottle 50.

In addition to the crushing means 33, a second difference between the invention 10 and the alternative embodiment 30 is that the plastic bottle 50 is inserted and removed from the front opening 31A from the housing 30. Also, the bottle crushing surface 33A is suspended below the top of the housing 31.

It shall be noted that the shape of the housing 31 and the corresponding shape of the bottle crushing surface 33A may be of any of a plurality of shapes. The housing 31, the bottle crushing surface 33A, and the tray 32 may be made of a material comprising wood, metal, a durable plastic, or a carbon fiber construction.

Figure 6A:
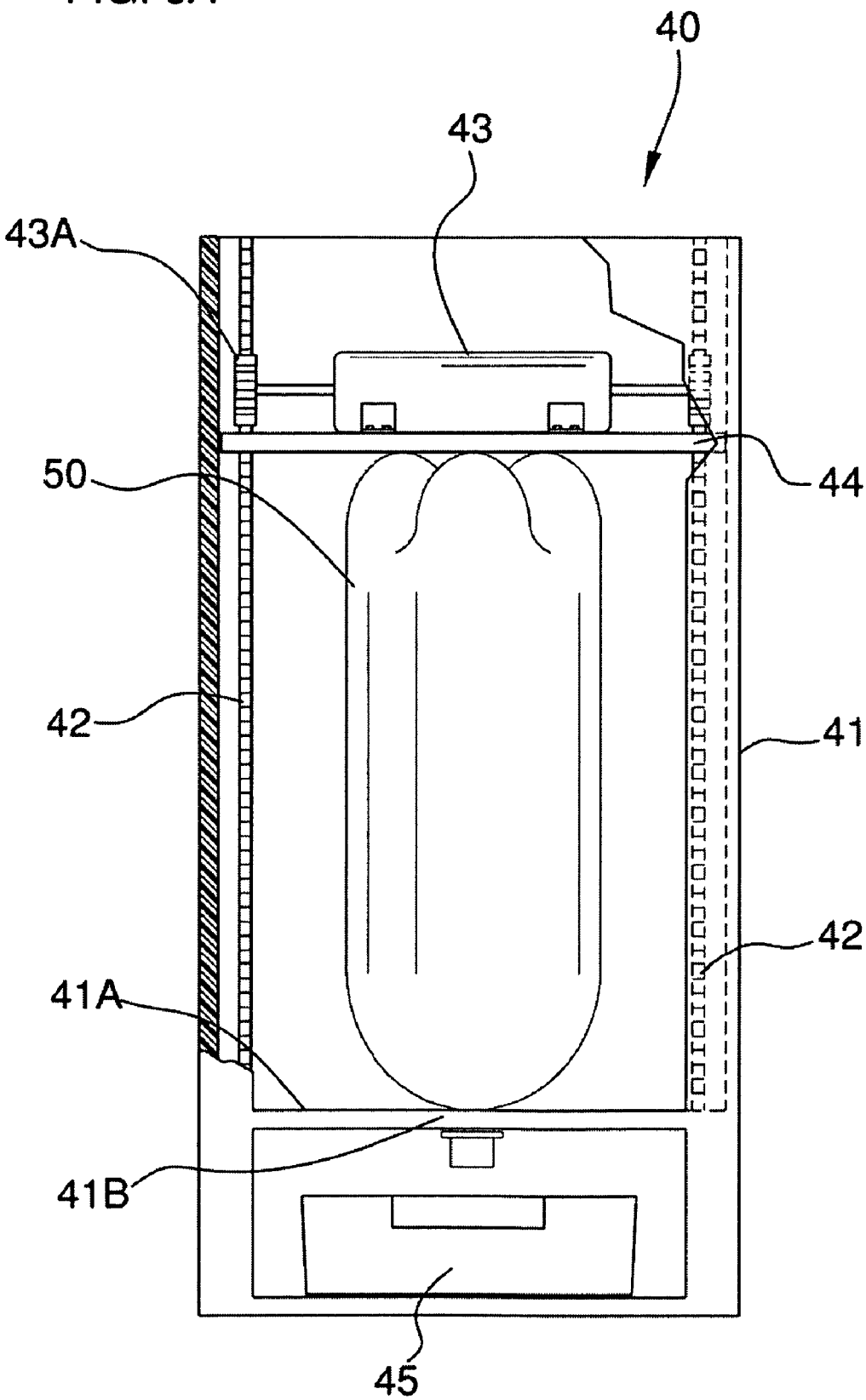
FIG. 6A illustrates a cross-sectional view of a third embodiment having a variation of an automated mechanical means of crushing said plastic bottle.

Referring to FIG. 6A, a third embodiment 40 involves similar componentry as the alternative embodiment 30. The main difference is that the third embodiment 40 has guide tracks 42, which run along an interior of a housing 41. A crushing surface 44 applies a downward force upon a bottle 50 via a motor 43 and sprockets 43A, wherein the sprockets 43A run along the guide tracks 42. The output of the motor 43 can either be directly connected to the sprockets 43A or power a gear reducer (not shown) that may be integrated into the housing of the motor 43. A bottom crushing surface 41A is located in the housing 41 and has a hole 41B wherein a top opening of the bottle 50 is inserted. The third embodiment 40 has a tray 45 that collects any leftover fluids of the bottle 50.

With respect to the above description, it is to be realized that the optimum dimensional relationship for the various components of the invention 10 and alternative embodiment 30, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and alternative embodiment 30.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A plastic bottle crushing mechanism comprising:

a housing has an upper front opening for ingress or egress of a plastic bottle, a lower front opening, a bottom crushing surface that has a hole located at a center for supporting said plastic bottle in an inverted position, and a top opening for ingress or egress of said plastic bottle;

a bottle crusher comprises a platen and a handle attached to a top surface of the platen, and the bottle crusher can pass through the top opening of the housing;

a tray slides into the lower front opening underneath the hole, a top end of said plastic bottle is inverted and placed upon said hole, and said tray collects any remaining liquid contained within said plastic bottle;

wherein the handle of the bottle crusher is manually pushed downward in order to engage the bottle between the bottle crusher and the bottom crushing surface thereby crushing said plastic bottle.

2. The plastic bottle crushing mechanism as described in claim 1 wherein the bottom crushing surface is secured to the housing such that the bottom crushing surface can withstand the force generated when crushing a plastic bottle.

3. The plastic bottle crushing mechanism as described in claim 2 wherein the housing is made of a material comprising a wood, metal, durable plastic, or carbon fiber construction.

4. The plastic bottle crushing mechanism as described in claim 2 wherein the tray is made of a material comprising a wood, metal, durable plastic, or carbon fiber construction.

5. The plastic bottle crushing mechanism as described in claim 2 wherein the bottle crusher is made of a material comprising a wood, metal, durable plastic, or carbon fiber construction.

6. A plastic bottle crushing mechanism comprising:

a housing has an upper front opening for ingress or egress of a plastic bottle, a lower front opening, a bottom crushing surface that has a hole located at a center for supporting said plastic bottle in an inverted position, and a top opening for ingress or egress of said plastic bottle;

a bottle crusher comprises a platen and a handle attached to a top surface of the platen, and the bottle crusher can pass through the top opening of the housing;

a tray slides into the lower front opening underneath the hole, a top end of said plastic bottle is inverted and placed upon said hole, and said tray collects any remaining liquid contained within said plastic bottle;

wherein the bottom crushing surface is secured to the housing such that the bottom crushing surface can withstand the force generated when crushing said plastic bottle;

wherein the handle of the bottle crusher is manually pushed downward in order to engage the bottle between the bottle crusher and the bottom crushing surface thereby crushing said plastic bottle.

7. The plastic bottle crushing mechanism as described in claim 6 wherein the housing is made of a material comprising a wood, metal, durable plastic, or carbon fiber construction.

8. The plastic bottle crushing mechanism as described in claim 6 wherein the tray is made of a material comprising a wood, metal, durable plastic, or carbon fiber construction.

9. The plastic bottle crushing mechanism as described in claim 6 wherein the bottle crusher is made of a material comprising a wood, metal, durable plastic, or carbon fiber construction.

* * * * *